US011529809B2

(12) United States Patent
Tsubamoto et al.

(10) Patent No.: US 11,529,809 B2
(45) Date of Patent: Dec. 20, 2022

(54) INK JET PRINTING RECORDING APPARATUS AND INK JET RECORDING METHOD

(71) Applicant: Seiko Epson Corporation, Toyko (JP)

(72) Inventors: Satoshi Tsubamoto, Shiojiri (JP); Kosuke Chidate, Shiojiri (JP); Minoru Yamada, Shiojiri (JP); Ryota Miyasa, Matsumoto (JP); Tasuku Nakamura, Matsumoto (JP)

(73) Assignee: SEIKO EPSON CORPORATION

( * ) Notice: Subject to any disclaimer, the term of this patent is extended or adjusted under 35 U.S.C. 154(b) by 37 days.

(21) Appl. No.: 17/195,742

(22) Filed: Mar. 9, 2021

(65) Prior Publication Data

US 2021/0283908 A1 Sep. 16, 2021

(30) Foreign Application Priority Data

Mar. 10, 2020 (JP) ..... JP2020-040695

(51) Int. Cl.

| | |
|---|---|
| ***B41J 2/045*** | (2006.01) |
| ***B41J 11/04*** | (2006.01) |
| ***B41J 11/00*** | (2006.01) |

(52) U.S. Cl.

CPC ..... *B41J 2/04563* (2013.01); *B41J 11/002* (2013.01); *B41J 11/04* (2013.01)

(58) Field of Classification Search

CPC ..... B41J 2/04563; B41J 11/002; B41J 11/04; B41J 2/195; B41J 11/007; B41J 29/38; B41J 11/00244; B41J 3/4078; B41J 2/01; B41J 15/048

See application file for complete search history.

(56) References Cited

U.S. PATENT DOCUMENTS

| | | | | |
|---|---|---|---|---|
| 2004/0114015 | A1* | 6/2004 | Tarnawskyj ..... | B41J 11/00244 347/101 |
| 2019/0292390 | A1 | 9/2019 | Ohashi et al. | |
| 2021/0146703 | A1 | 5/2021 | De Roeck | |

FOREIGN PATENT DOCUMENTS

| | | | |
|---|---|---|---|
| CN | 110305530 | A | 10/2019 |
| CN | 110621508 | A | 12/2019 |
| EP | 3403833 | A1 | 11/2018 |
| JP | 2018-192733 | A | 12/2018 |

* cited by examiner

*Primary Examiner* — Bradley W Thies

(74) *Attorney, Agent, or Firm* — Harness, Dickey & Pierce, P.L.C.

(57) ABSTRACT

An ink jet printing recording apparatus includes a belt which supports a recording medium; a heating portion which heats the belt; and an ink jet recording head which ejects an ink jet ink composition, the belt is provided with an adhesive layer, the ink jet ink composition contains a heat cross-linking component, and the belt is heated by the heating portion to a temperature lower than a reaction temperature of the heat cross-linking component.

9 Claims, 2 Drawing Sheets

INK JET PRINTING RECORDING APPARATUS AND INK JET RECORDING METHOD

The present application is based on, and claims priority from JP Application Serial Number 2020-040695, filed Mar. 10, 2020, the disclosure of which is hereby incorporated by reference herein in its entirety.

BACKGROUND

1. Technical Field

The present disclosure relates to an ink jet printing recording apparatus and an ink jet recording method.

2. Related Art

A technique in which printing is performed by adhering an ink to a cloth or the like using an ink jet method has been known. For example, JP-A-2018-192733 has disclosed a printing apparatus in which a medium, such as a cloth, to be printed is transported by a transport belt, and an ink is ejected from a recording head so as to be adhered to the medium. In order to stably transport the medium, the transport belt as described above may be formed in some cases from a material to which the medium can be adhered. In addition, JP-A-2018-192733 has also disclosed that the apparatus includes a heating portion which heats the cloth, and the heating portion can be transferred even when the transportation of the medium is stopped, and hence, the texture of the medium is not likely to deteriorate.

As disclosed in JP-A-2018-192733, the structure in which in printing, the transport belt is heated has been known. However, when the transport belt is heated, it is not sufficient to prevent the texture of the medium from deteriorating, and various matters other than that described above also have to be taken into consideration. In addition, since those matters may be related to each other in some cases, and hence, for example, when one matter is improved, another matter may unfavorably become insufficient in many cases.

As the matters which are related to each other, for example, an improvement in abrasion fastness of an image and a deterioration in washing property of an ink adhered to the transport belt may be mentioned. In the case in which the transport belt is heated, when the abrasion fastness of an image is tried to improve, the washing property of an ink adhered to the transport belt may deteriorate in some cases. Hence, the abrasion fastness of an image and the washing property of the belt are both required to improve.

SUMMARY

According to an aspect of the present disclosure, there is provided an ink jet printing recording apparatus which comprises: a belt which supports a recording medium; a heating portion which heats the belt; and an ink jet recording head which ejects an ink jet ink composition. In the ink jet printing recording apparatus described above, the belt is provided with an adhesive layer, the ink jet ink composition contains a heat cross-linking component, and by the heating portion, the belt is heated to a temperature lower than a reaction temperature of the heat cross-linking component.

According to another aspect of the present disclosure, there is provided an ink jet recording method which comprises: a step of heating a belt which is provided with an adhesive layer and which supports a recording medium; and a step of ejecting an ink jet ink composition from an ink jet recording head so as to be adhered to the recording medium supported by the belt. In the ink jet recording method described above, the ink jet ink composition contains a heat cross-linking component, and in the step of heating a belt, the belt is heated to a temperature lower than a reaction temperature of the heat cross-linking component.

DESCRIPTION OF EXEMPLARY EMBODIMENTS

Figure 1:
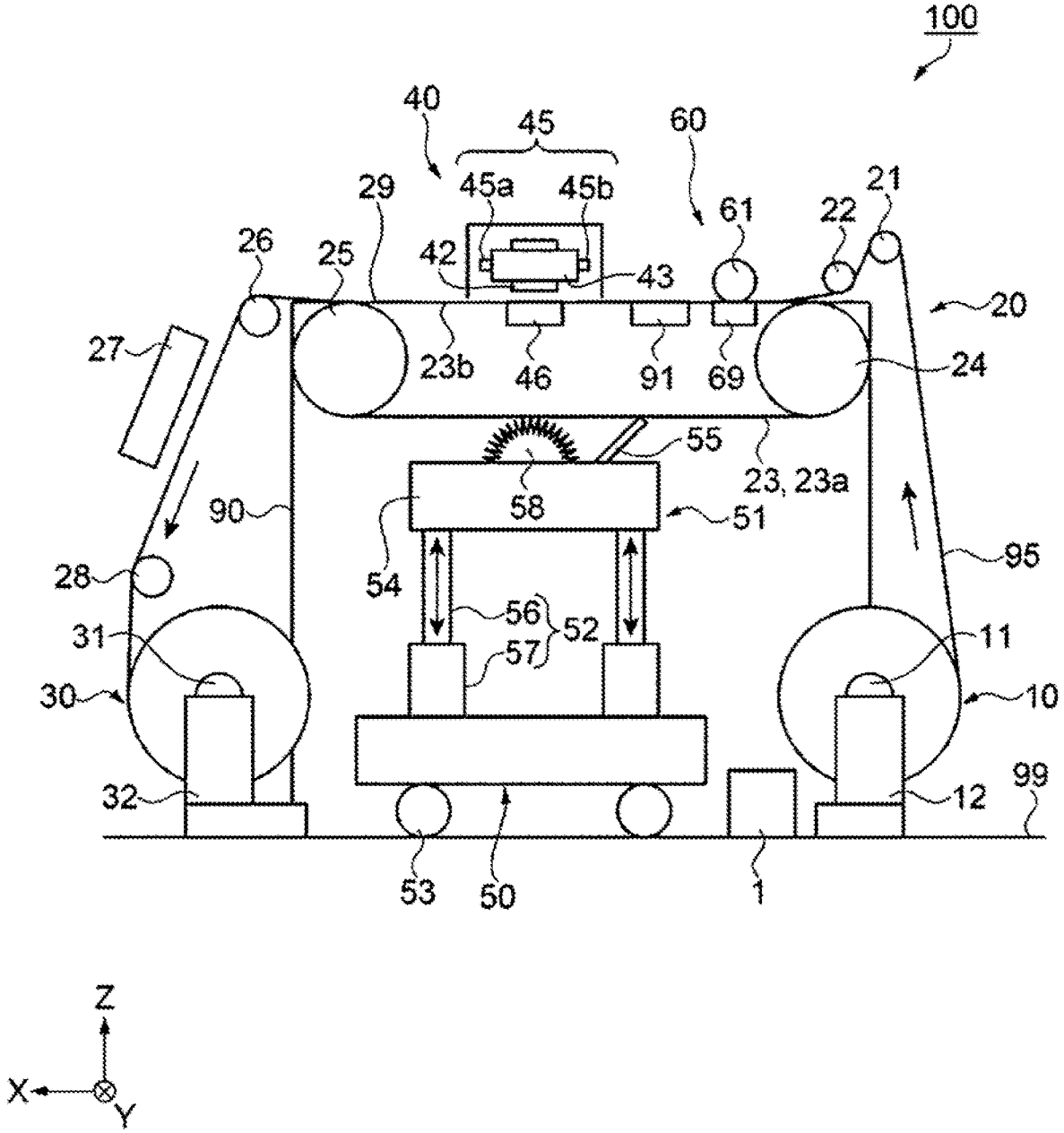
FIG. 1 is a schematic view showing an entire structure of a printing apparatus according to an embodiment.

Hereinafter, embodiments of the present disclosure will be described. The following embodiments are to explain examples of the present disclosure. The present disclosure is not limited to the following embodiments and also includes various changed and/or modified embodiments to be performed within the scope of the present disclosure. In addition, all constitutions to be described below are each not always required to be an essential constitution.

1. Ink Jet Printing Recording Apparatus

An ink jet printing recording apparatus according to an embodiment includes a belt which supports a recording medium, a heating portion which heats the belt, and an ink jet recording head which ejects an ink jet ink composition. In addition, the belt is provided with an adhesive layer, the ink jet ink composition contains a heat cross-linking component, and by the heating portion, the belt is heated to a temperature lower than a reaction temperature of the heat cross-linking component.

Hereinafter, an ink jet printing recording apparatus 100 according to this embodiment will be described with reference to the drawing. In addition, in the drawing, in order to easily recognize layers and members, the scales of the layers and the members are made different from the actual scales.

In addition, in FIG. 1, for the convenience of illustration, as three axes orthogonal to each other, an X axis, a Y axis, and a Z axis are shown, and a front end side and a base end side of an arrow indicating an axial direction represent a "+ side" and a "− side", respectively. A direction along the X axis, a direction along the Y axis, and a direction along the Z axis are represented by an "X axis direction", a "Y axis direction", and a "Z axis direction", respectively.

Schematic Structure of Ink Jet Printing Recording Apparatus

FIG. 1 is a schematic view showing an entire structure of the ink jet printing recording apparatus 100 according to this embodiment. First, the entire structure of the ink jet printing recording apparatus 100 according to this embodiment will be described with reference to FIG. 1. In addition, in this embodiment, an ink jet-type ink jet printing recording apparatus 100 which performs printing on a recording medium 95 to form an image or the like thereon will be described by way of example.

As shown in FIG. 1, the ink jet printing recording apparatus 100 includes, for example, a medium transport portion 20, a medium contact portion 60, a belt support portion 91, a print portion 40, a heating unit 27, and a washing unit 50. In the ink jet printing recording apparatus 100, at least one of the medium contact portion 60 and the belt support portion 91 corresponds to a heating portion which heats a belt. In addition, the ink jet printing recording apparatus 100 also includes a control portion 1 which controls the portions mentioned above. The portions of the ink jet printing recording apparatus 100 are each fitted to a frame portion 90.

In addition, the heating portion which heats a belt may be provided upstream than the print portion 40 in a transport direction and may be provided at a position different from that of each of the medium contact portion 60 and the belt support portion 91. For example, the heating portion may also be provided upstream than the medium contact portion 60 in the transport direction. Since the structure as described above is formed, the heating portion can also dry a wet belt which is wetted in washing. In addition, the heating portion may be configured to dry a belt in a non-contact manner.

The medium transport portion 20 transports the recording medium 95 in the transport direction. The medium transport portion 20 includes a medium supply portion 10, transport rollers 21 and 22, a belt 23, a belt rotation roller 24, a belt drive roller 25 as a drive roller, transport rollers 26 and 28, and a medium recovery portion 30.

First, a transport path of the recording medium 95 from the medium supply portion 10 to the medium recovery portion 30 will be described. In addition, in this embodiment, a direction along which the gravity acts is regarded as the Z axis direction, a direction along which the recording medium 95 is transported in the print portion 40 is regarded as the X axis direction, and a width direction of the recording medium 95 which intersects both the Z axis direction and the X axis direction is regarded as the Y axis direction. In addition, a positional relationship along the transport direction of the recording medium 95 or a transfer direction of the belt 23 is also called "upstream" or "downstream".

The medium supply portion 10 is to supply the recording medium 95 on which an image is to be formed to a print portion 40 side. As the recording medium 95, for example, a cloth formed from, for example, a cotton, a silk, a wool, or a polyester may be used. The medium supply portion 10 includes a supply shaft portion 11 and a bearing portion 12. The supply shaft portion 11 is formed to have a cylindrical shape or a columnar shape and is rotatably provided in a circumferential direction. Around the supply shaft portion 11, the belt-shaped recording medium 95 is wound to have a roll shape. The supply shaft portion 11 is detachably fitted to the bearing portion 12. Accordingly, the recording medium 95 wound around the supply shaft portion 11 in advance can be fitted to the bearing portion 12 together with the supply shaft portion 11.

The bearing portion 12 rotatably supports two ends of the supply shaft portion 11 in a shaft direction. The medium supply portion 10 includes a rotation drive portion (not shown) which rotatably drives the supply shaft portion 11. The rotation drive portion rotates the supply shaft portion 11 in a direction to which the recording medium 95 is supplied. The operation of the rotation drive portion is controlled by the control portion 1. The transport rollers 21 and 22 transport the recording medium 95 from the medium supply portion 10 to the belt 23.

The belt 23 is supported between at least two rollers which rotate the belt 23, and since the belt 23 is rotatably transferred, the recording medium 95 is transported in the transport direction (+X axis direction) while being supported by the belt 23. In particular, the belt 23 is formed by coupling two end portions of a belt-shaped belt and is stretched between the two rollers, that is, the belt rotation roller 24 and the belt drive roller 25. As the belt 23, since an endless belt, that is, a seamless belt, is used, a stabler transportation of the recording medium 95 can be performed.

The belt 23 is maintained with a predetermined tensile force so as to be flat between the belt rotation roller 24 and the belt drive roller 25. On a surface (support surface) 23*a* of the belt 23, an adhesive 29 to which the recording medium 95 is adhered is applied. That is, the belt 23 is provided with an adhesive layer formed from the adhesive 29. The recording medium 95 is adhered to the belt 23 with the adhesive 29 interposed therebetween. The belt 23 supports (maintains) the recording medium 95 which is supplied from the transport roller 22 and which is adhered to the adhesive 29 by the medium contact portion 60 which will be described later. Accordingly, for example, a cloth having a stretching property may be used as the recording medium 95.

The adhesive 29 is preferable when its adhesive property is enhanced by heating. Since an adhesive 29 having an adhesive property which is enhanced by heating is used, the recording medium 95 and the adhesive layer are preferably adhered to each other. As the adhesive 29 described above, for example, a hot-melt adhesive containing a thermoplastic elastomer SIS as a primary component may be used. As a particular example of the adhesive, for example, there may be mentioned "Polix Resin", "Newdine", or "Aquadine" Series manufactured by Yokohama Polymer Research Institute; "MC Polymer Series" manufactured by Murayama Chemical Laboratory Co., Ltd.; "Unikenzol RV-30 (for screen printing)" manufactured by Union Chemical Industry Co., Ltd.; "Plaster EH" manufactured by Shin-Nakamura Chemical Co., Ltd.; or "ATRAS01 GP1 (ATR code: ATR1717)" manufactured by ATR Chemicals.

The belt rotation roller 24 and the belt drive roller 25 support an inner circumferential surface 23*b* of the belt 23. Between the belt rotation roller 24 and the belt drive roller 25, a contact portion 69, the belt support portion 91, and a platen 46, each of which support the belt 23, are provided. The contact portion 69 is provided in a region facing a press portion 61 which will be described later with the belt 23 interposed therebetween, the platen 46 is provided in a region facing the print portion 40 with the belt 23 interposed therebetween, and the belt support portion 91 is provided between the contact portion 69 and the platen 46. Since the contact portion 69, the belt support portion 91, and the platen 46 support the belt 23, for example, vibration of the belt 23 which occurs in association with the transfer of the belt 23 can be suppressed.

In at least one of the contact portion 69 and the belt support portion 91, a heater which heats the belt 23 is provided. The heater forms the heating portion. When the heater is provided in the contact portion 69, since a press force and heat can be applied to the belt 23 by the press portion 61, the adhesion between the belt 23 and the recording medium 95 can be preferably improved. Hence, when being provided in one of the contact portion 69 and the belt support portion 91, the heater is preferably provided in the contact portion 69.

The heating portion enables the adhesive layer to exhibit an adhesive property by softening thereof with heat application, so that the adhesion between the recording medium and the adhesive layer is improved. Accordingly, the recording medium on the belt is suppressed from moving, and hence, a preferable transport accuracy can be obtained.

When the heater is provided in at least one of the contact portion 69 and the belt support portion 91, and the belt 23 is heated, the surface 23*a* of the belt 23 is heated to a temperature lower than a reaction temperature of a heat cross-linking component which will be described later. The temperature of the surface 23*a* of the belt 23 in this case is a maximum reaching temperature. By the operation as described above, in all the regions in which the belt 23 and the recording medium 95 are in contact with each other, a region in which the temperature is increased to the reaction temperature or more of the heat cross-linking component can be prevented from being generated over the entire surface of the belt 23. In addition, a lower limit of the temperature of the surface 23*a* of the belt 23 is not particularly limited as long as the adhesive property of the adhesive layer is obtained and is preferably 30° C. or more, more preferably 35° C. or more, and further preferably 40° C. or more.

That is, in a region in which the ink jet ink composition may be probably adhered to the belt 23, the belt 23 is not heated to a temperature higher than the reaction temperature of the heat cross-linking component of the ink jet ink composition. Accordingly, even if the ink jet ink composition is adhered to the belt 23, since the belt 23 reaches the washing portion 51 in a state in which the reaction of the heat cross-linking component is not yet completed, the ink jet ink composition thus adhered can be easily washed out. In addition, the temperature of the surface 23*a* of the belt 23 can be measured, for example, by a radiation type thermometer or a contact type thermometer and is more preferably measured by a radiation type thermometer.

When the heater is provided in at least one of the contact portion 69 and the belt support portion 91, a temperature detection portion (not shown) which detects a surface temperature of the belt 23 may also be provided. As the temperature detection portion, for example, a thermo couple may be used. Accordingly, since the control portion 1 controls the heater based on the temperature detected by the temperature detection portion, the belt 23 can be controlled at a predetermined temperature. In addition, the temperature detection portion may use a non-contact type thermometer which uses infrared rays.

The belt drive roller 25 is a drive portion which transports the recording medium 95 in the transport direction by the rotation of the belt 23 and includes a motor (not shown) which rotatably drives the belt drive roller 25. The belt drive roller 25 is provided downstream than the print portion 40 in the transport direction of the recording medium 95, and the belt rotation roller 24 is provided upstream than the print portion 40. When the belt drive roller 25 is rotatably driven, in association with the rotation of the belt drive roller 25, the belt 23 is rotated, and by the rotation of the belt 23, the belt rotation roller 24 is rotated. By the rotation of the belt 23, the recording medium 95 supported by the belt 23 is transported in the transport direction (+X axis direction), and an image is formed on the recording medium 95 by the print portion 40 which will be described later.

In this embodiment, at a side (+Z axis direction) of the surface 23*a* of the belt 23 which faces the print portion 40, the recording medium 95 is supported, and the recording medium 95 is transported with the belt 23 from a belt rotation roller 24 side to a belt drive roller 25 side. In addition, at a side (−Z axis direction) of the surface 23*a* of the belt 23 which faces the washing unit 50, the belt 23 is only transferred from the belt drive roller 25 side to the belt rotation roller 24 side.

The transport roller 26 peels the recording medium 95 on which an image is formed from the adhesive 29 on the belt 23. The transport rollers 26 and 28 transport the recording medium 95 from the belt 23 to the medium recovery portion 30.

The medium recovery portion 30 recovers the recording medium 95 transported by the medium transport portion 20. The medium recovery portion 30 includes a winding shaft portion 31 and a bearing portion 32. The winding shaft portion 31 is formed to have a cylindrical or a columnar shape and is rotatably provided in a circumferential direction. The belt-shaped recording medium 95 is wound around the winding shaft portion 31 to form a roll shape. The winding shaft portion 31 is detachably fitted to the bearing portion 32. Accordingly, the recording medium 95 wound around the winding shaft portion 31 can be detached therewith.

The bearing portion 32 rotatably supports two ends of the winding shaft portion 31 in a shaft direction. The medium recovery portion 30 includes a rotation drive portion (not shown) which rotatably drives the winding shaft portion 31. The rotation drive portion rotates the winding shaft portion 31 in a direction in which the recording medium 95 is wound. The operation of the rotation drive portion is controlled by the control portion 1.

Next, the print portion 40, the heating unit 27, and the washing unit 50 provided along the medium transport portion 20 will be described.

The print portion 40 is disposed above (+Z axis direction) with respect to the arrangement position of the belt 23 and is able to perform printing on the recording medium 95 disposed on the surface 23*a* of the belt 23. The print portion 40 includes a head unit 42, a carriage 43 on which the head unit 42 is mounted, and a carriage transfer portion 45 which transfers the carriage 43 in a width direction (Y axis direction) of the recording medium 95 intersecting the transport direction. The head unit 42 includes a plurality of ink jet recording heads (not shown) which eject liquid droplets of ink jet ink compositions (such as yellow, cyan, magenta, and black ink compositions (which will be described later)) supplied from an ink supply portion (now shown) on the recording medium 95 disposed on the belt 23.

The carriage transfer portion 45 is provided above (+Z axis direction) the belt 23. The carriage transfer portion 45 includes a pair of guide rails 45*a* and 45*b* extending along the Y axis direction. The head unit 42 is supported by the guide rails 45*a* and 45*b* together with the carriage 43 so as to be reciprocally movable along the Y axis direction.

The carriage transfer portion 45 includes a transfer mechanism and a power source (not shown). As the transfer mechanism, for example, a mechanism in which a ball screw and a ball nut are used in combination or a linear guide mechanism may be used. Furthermore, the carriage transfer portion 45 includes, as a power source, a motor (not shown) which transfers the carriage 43 along the guide rails 45*a* and 45*b*. As the motor, various types of motors, such as a stepping motor, a servo motor, or a linear motor may be used. When the motor is driven by the control of the control portion 1, the head unit 42 is transferred in the Y axis direction together with the carriage 43.

The heating unit 27 is provided between the transport rollers 26 and 28. The heating unit 27 heats the ink jet ink composition ejected on the recording medium 95. Accordingly, the reaction of the heat cross-linking component of the ink jet ink composition can be sufficiently advanced. Since the heat cross-linking component sufficiently reacts, an image having a preferable abrasion fastness can be formed. In addition, the heating unit 27 may also be used in order to dry the recording medium 95. In the heating unit 27, for example, an IR heater may be included, and by driving the IR heater, the ink jet ink composition ejected on the recording medium 95 is allowed to sufficiently react in a short time. Accordingly, the belt-shaped recording medium 95 on which an image or the like is formed can be wound around the winding shaft portion 31.

The washing unit 50 is disposed between the belt rotation roller 24 and the belt drive roller 25 in the X axis direction. The washing unit 50 includes a washing portion 51, a press portion 52, and a transfer portion 53. The transfer portion 53 collectively transfers the washing unit 50 along a floor surface 99 and fixes it at a predetermined position.

The press portion 52 is a lifting device formed of an air cylinder 56 and a ball bush 57, and the washing portion 51 provided at an upper side of the press portion 52 is to be brought into contact with the surface 23*a* of the belt 23. The washing portion 51 washes the surface (support surface) 23*a* of the belt 23 from a bottom side (−Z axis direction), the belt 23 being stretched between the belt rotation roller 24 and the belt drive roller 25 by a predetermined tensile force and transferring from the belt drive roller 25 to the belt rotation roller 24.

The washing portion 51 includes a washing bath 54, a washing roller 58, and a blade 55. The washing bath 54 is a bath which stores a washing liquid to be used for washing of inks and foreign materials adhered to the surface 23*a* of the belt 23, and the washing roller 58 and the blade 55 are provided in the washing bath 54. As the washing liquid, for example, water or a water-soluble solvent (such as an aqueous alcohol solution) may be used, and if needed, a surfactant and/or a defoaming agent may also be added.

When the washing roller 58 is rotated, the washing liquid is supplied to the surface 23*a* of the belt 23, and at the same time, the washing roller 58 and the belt 23 are rubbed with each other. Accordingly, for example, the ink jet ink composition and fibers of a cloth used as the recording medium 95, which are adhered to the belt 23, are removed by the washing roller 58.

The blade 55 may be formed using a flexible material, such as a silicone rubber. The blade 55 is provided downstream than the washing roller 58 in the transport direction of the belt 23. Since the belt 23 and the blade 55 are rubbed with each other, a washing liquid remaining on the surface 23*a* of the belt 23 can be removed.

Electric Configuration

Figure 2:
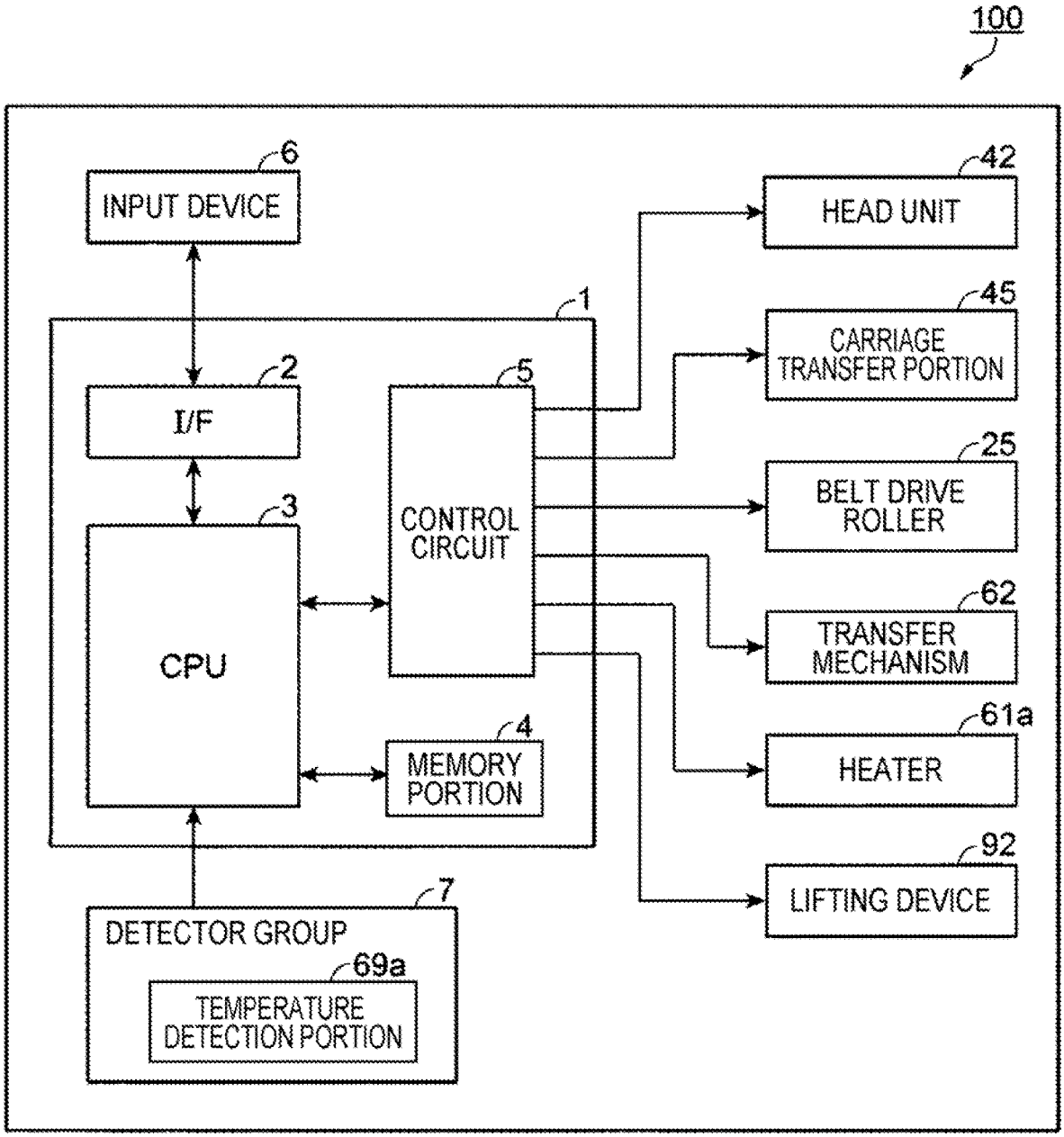
FIG. 2 is an electric block diagram showing an electric configuration of the printing apparatus.

FIG. 2 is an electric block diagram showing an electric configuration of the ink jet printing recording apparatus 100. Next, the electric configuration of the ink jet printing recording apparatus 100 will be described with reference to FIG. 2.

The ink jet printing recording apparatus 100 includes, for example, an input device 6 into which printing conditions and the like are input and the control portion 1 which controls the portions of the ink jet printing recording apparatus 100. As the input device 6, a desktop or a laptop personal computer (PC), a tablet terminal, a mobile terminal, or the like may be used. The input device 6 may be provided separately from the ink jet printing recording apparatus 100.

The control portion 1 is formed using an interface portion (I/F) 2, a central processing unit (CPU) 3, a memory portion 4, a control circuit 5, and the like. The interface portion 2 is a receiving portion which receives information on the printing conditions, the types of media, and the like input by the input device 6. The interface portion 2 transmits and receives data between the control portion 1 and the input device 6 which handles input signals and images. The CPU 3 is an arithmetic processing device which performs a processing of input signals from various types of detector groups 7 including a temperature detection portion and which controls a printing operation of the ink jet printing recording apparatus 100. The memory portion 4 is a memory medium which secures a region to store the program of the CPU 3 and an operation region thereof and which includes memory elements, such as a random access memory (RAM) and an electrically erasable programmable read only memory (EEPROM).

The control portion 1 controls an ejection head provided in the head unit 42 by a control signal output from the control circuit 5 to eject an ink to the recording medium 95. The control portion 1 controls the drive of the motor provided in the carriage transfer portion 45 by a control signal output from the control circuit 5 to reciprocally transfer the carriage 43 on which the head unit 42 is mounted in a main scanning direction (Y axis direction). The control portion 1 controls the drive of the motor provided in the belt drive roller 25 by a control signal output from the control circuit 5 to rotatably transfer the belt 23. Accordingly, the recording medium 95 disposed on the belt 23 is transferred in the transport direction (+X axis direction).

Based on the temperature detected by the temperature detection portion (not shown) provided, for example, in the contact portion 69 or the belt support portion 91, the control portion 1 controls a voltage to be applied to each heater or the like by a control signal output from the control circuit 5, so that an amount of heat generated from the heater is controlled. In addition, the control portion 1 controls various devices (not shown) by control signals output from the control circuit 5.

2. Ink Jet Ink Composition

An ink jet ink composition to be used for the ink jet printing recording apparatus of this embodiment contains at least a heat cross-linking component. Hereinafter, an ink jet ink composition of this embodiment will be described.

2.1. Heat Cross-Linking Component

As the heat cross-linking component contained in the ink jet ink composition, a component which forms a cross-linked molecular structure between molecules and/or in one molecule by heating may be mentioned. As an example of the heat cross-linking component, a component which forms an urethane bond by a reaction may be mentioned. As the heat cross-linking component described above, a mixture of a compound having at least two hydroxy groups and a compound having at least two isocyanate groups or a compound having both a hydroxy group and an isocyanate group in one molecule may be mentioned. The mixture described above may be either in an unreacted state or in a reacted state in which the viscosity of the ink jet ink composition is in an appropriate range. That is, an urethane resin in which polymerization is advanced to a certain extent may also be used, and in the case described above, the heat cross-linking component can be represented as an urethane resin having a cross-linking group. In addition, the isocyanate group may be a group blocked by a blocking agent.

As an example of the compound having at least two hydroxy groups, for example, there may be mentioned a linear chain aliphatic glycol, such as ethylene glycol, propylene glycol, 1,3-propanediol, 1,3-butanediol, 1,4-butanediol, 1,5-pentanediol, 1,2-pentanediol, 3-methyl-1,5-pentanediol, 1,6-hexanediol, 1,2-hexanediol, diethylene glycol, triethylene glycol, tetraethylene glycol, dipropylene glycol, tripropylene glycol, a polyethylene glycol, a polypropylene glycol, 1,8-octanediol, 1,2-octanediol, or 1,9-nonanediol; a branched aliphatic glycol, such as neopentyl glycol, 3-methyl-1,5-pentanediol, 2-methyl-1,3-propanediol, 2,2-dimethyl-1,3-propanediol, 2-butyl-2-ethyl-1,3-propanediol, 2,2-dibutyl-1,3-propanediol, or 2-methyl-1,8-octanediol; a cycloaliphatic glycol, such as 1,4-cyclohexanediol or 1,4-cyclohexanedimethanol; or a polyfunctional glycol, such as glycerin, trimethylolethane, trimethylolpropane, tributylolpropane, pentaerythritol, or sorbitol. Those may be used alone, or at least two types thereof may be used in combination.

In addition, as the compound having at least two hydroxy groups, a polyester polyol may also be used. The polyester polyol may be obtained, for example, by a known method in which a divalent carboxylic acid or a carboxylic acid anhydride is dehydration-condensed with the following glycol or ether.

Hereinafter, a particular compound to be used for the formation of a polyester polyol which can be used for the ink jet ink composition may be mentioned. As a saturated or an unsaturated glycol, various types of glycols may be mentioned, and for example, a linear aliphatic glycol, such as ethylene glycol, propylene glycol, 1,3-propanediol, 1,3-butanediol, 1,4-butanediol, 1,5-pentanediol, 1,2-pentanediol, 3-methyl-1,5-pentanediol, 1,6-hexanediol, 1,2-hexanediol, diethylene glycol, triethylene glycol, tetraethylene glycol, dipropylene glycol, tripropylene glycol, a polyethylene glycol, a polypropylene glycol, 1,8-octanediol, 1,2-octanediol, or 1,9-nonanediol; a branched aliphatic glycol, such as neopentyl glycol, 3-methyl-1,5-pentanediol, 2-methyl-1,3-propanediol, 2,2-dimethyl-1,3-propanediol, 2-butyl-2-ethyl-1,3-propanediol, 2,2-dibutyl-1,3-propanediol, or 2-methyl-1,8-octanediol; a cycloaliphatic glycol, such as 1,4-cyclohexanediol or 1,4-cyclohexanedimethanol; or a polyfunctional glycol, such as glycerin, trimethylolethane, trimethylolpropane, tributylolpropane, pentaerythritol, or sorbitol, may be mentioned.

As the ether, for example, there may be mentioned an alkyl glycidyl ether, such as n-butyl glycidyl ether or 2-ethylhexyl glycidyl ether, or a monocarboxylic acid glycidyl ester, such as glycidyl ester versatate.

As the divalent carboxylic acid or the acid anhydride, for example, there may be mentioned a dibasic acid, such as adipic acid, maleic acid, fumaric acid, phthalic anhydride, isophthalic acid, terephthalic acid, succinic acid, oxalic acid, malonic acid, glutaric acid, pimelic acid, azelaic acid, sebacic acid, or suberic acid; an acid anhydride or a dimer acid corresponding to one of those mentioned above; or a castor oil or its aliphatic acid. Besides the polyester polyol obtained by dehydration condensation using the compounds mentioned above, a polyester polyol obtained by ring-opening polymerization of a cyclic ester compound may also be mentioned.

As a particular example of the polyester polyol, for example, poly[3-methyl-1,5-pentanediol]-alt-(adipic acid)] (Kuraray Polyol P2010, manufactured by Kuraray Co., Ltd.) obtained by dehydration condensation between 3-methyl-1,5-pentanediol and adipic acid has been commercially available.

As the compound having at least two hydroxy groups, a polycarbonate polyol may also be used. The polycarbonate polyol is formed in general through a reaction, such as a demethanol condensation reaction between a polyvalent alcohol and dimethyl carbonate, a dephenol condensation reaction between a polyvalent alcohol and diphenyl carbonate, or a deethylene glycol condensation reaction between a polyvalent alcohol and ethylene carbonate. As the polyvalent alcohol used in the reactions mentioned above, for example, there may be mentioned a saturated or an unsaturated glycol, such as 1,6-hexanediol, diethylene glycol, triethylene glycol, propylene glycol, 1,3-butanediol, 1,4-butanediol, neopentyl glycol, pentanediol, 3-methyl-1,5-penetanediol, octanediol, 1,4-butynediol, dipropylene glycol, tripropylene glycol, or a polytetramethylene glycol; or a cycloaliphatic glycol, such as 1,4-cyclohexane glycol or 1,4-cyclohexane dimethanol.

An urethane resin having a structure derived from the polycarbonate polyol as described above may be called a polycarbonate-based urethane resin. When the polycarbonate polyol is used, among mechanical properties of a polyurethane (urethane resin) purified after the reaction, a rupture elongation of 200% to 600% is likely to be obtained. When the rupture elongation is 150% to 800% and preferably 200% to 600%, the abrasion fastness of a recorded matter (printed matter) by the ink jet ink composition can be further improved.

As a particular example of the polycarbonate polyol, for example, a compound (PES-EXP815, manufactured by Nippon Polyurethane Industry Co., Ltd.) containing 1,6-hexanediol as a primary component may be mentioned. In addition, as a polyol which may be used in the present disclosure, for example, Actocol EP3033 (manufactured by Mitsui Chemical Urethane Co., Ltd.), PREMINOL 7003 (manufactured by Asahi Glass Co., Ltd.), PREMINOL 7001 (manufactured by Asahi Glass Co., Ltd.), or Adeka Polyether AM302 (manufactured by ADEKA Corporation) has been commercially available.

As the compound having at least two isocyanate groups, for example, there may be mentioned diethylene diisocyanate, tetramethylene diisocyanate, hexamethylene diisocyanate, trimethylhexamethylene diisocyanate, cyclohexane diisocyanate, 1,3-bis(isocyanatomethyl)cyclohexane, isophorone diisocyanate, 2,6-bis(isocyanatomethyl)decahydronaphthalene, lysine triisocyanate, 2,4-tolylene diisocyanate, 2,6-tolylene diisocyanate, o-tolidine diisocyanate, 4,4'-diphenylmethane diisocyanate, diphenyl ether diisocyanate, 3-(2'-isocyanatecyclohexyl)propylisocyanate, tris(phenylisocyanate)thiophosphate, isopropylidene bis(cyclohexyl isocyanate), 2,2'-bis(4-isocyanatephenyl)propane, triphenylmethane triisocyanate, bis(diisocyanatetolyl)phenylmethane, 4,4',4"-triisocyanate-2,5-dimethoxyphenylamine, 3,3'-dimethoxybenzidine-4,4'-diisocyanate, 1,3-phenylene diisocyanate, 1,4-phenylene diisocyanate, 4,4'-diisocyanatobiphenyl, 4,4'-diisocyanato-3,3'-dimethylbiphenyl, dicyclohexylmethane-4,4'-diisocyanate, 1,1'-methylenebis(4-isocyanatobenzene), 1,1'-methylenebis(3-methyl-4-isocyanatobenzene), m-xylylene diisocyanate, p-xylylene diisocyanate, 1,3-bis(1-isocyanate-1-methylethyl)benzene, 1,4-bis(1-isocyanate-1-methylethyl)benzene, 1,3-bis(2-isocyanato-2-propyl)benzene, 2,6-bis(isocyanatomethyl)tetrahydrodicyclopentadiene, bis(isocyanatomethyl)dicyclopentadiene, bis(isocyanatomethyl)tetrahydrothiophene, bis(isocyanatomethyl)thiophene, 2,5-di(isocyanatemethyl) norbornene, bis(isocyanatomethyl)adamantane, 3,4-diisocyanateselenophane, 2,6-diisocyanate-9-selenabicyclononane, bis(isocyanatomethyl)selenophane, 3,4-diisocyanate-2,5-diselenolane, dimer acid diisocyanate, 1,3,5-tri(1-isocyanatohexyl)isocyanuric acid, 2,5-diisocyanatomethyl-1,4-dithiane, 2,5-bis(isocyanatomethyl-4-isocyanate-2-thiabutyl)-1,4-dithiane, 2,5-bis(3-isocyanate-2-thiapropyl)-1,4-dithiane, 1,3,5-triisocyanatocyclohexane, 1,3,5-tris (isocyanatomethyl)cyclohexane, bis(isocyanatomethylthio) methane, 1,5-diisocyanate-2-isocyanatomethyl-3-thiapentane, 1,2,3-tris(isocyanatoethylthio)propane, 1,2,3-(isocyanatomethylthio)propane, 1,1,6,6-tetrakis (isocyanatomethyl)-2,5-dithiahexane, 1,1,5,5-tetrakis (isocyanatomethyl)-2,4-dithiapentane, 1,2-bis (isocyanatomethylthio)ethane, or 1,5-diisocyanate-3-isocyanatomethyl-2,4-dithiapentane. In addition, for example, a dimer obtained by a biuret type reaction of each of those polyisocyanates, a cyclic trimer obtained from each of those polyisocyanates, or an adduct between each of those polyisocyanates and an alcohol or a thiol may also be used. Furthermore, a compound in which some or all of isocyanate groups of the polyisocyanate mentioned above are changed to isothiocyanate groups may also be used. In addition, those compounds may be used alone, or at least two types thereof may be used by mixing.

The heat cross-linking component is preferably an urethane resin having a cross-linking group. As a commercially available product of the heat cross-linking component described above, for example, ETANACOLL (registered trademark) UW series manufactured by Ube Industries, Ltd. may be mentioned, and as the model number, for example, UW-1527F, UW-1614AF, or UW-2201AF is commercially available. When the heat cross-linking component is an urethane resin having a cross-linking group, the abrasion fastness of an image can be improved.

A polyurethane (urethane resin) obtained by polymerization of each of the monomers mentioned above preferably has a glass transition temperature of 30° C. or less. Since a polyurethane (urethane resin) having a glass transition temperature of 30° C. or less is used, an ink jet ink composition excellent not only in abrasion resistance and dry cleaning resistance but also in ejection stability can be realized. A more preferable glass transition temperature is 25° C. or less. In addition, the glass transition temperature indicates a value measured in accordance with JIS K6900.

In addition, the polyurethane (urethane resin) used as the heat cross-linking component has an acid value of 100 mgKOH/g or less. Since a polyurethane (urethane resin) having an acid value of 100 mgKOH/g or less is used, an ink jet ink composition excellent not only in abrasion resistance and dry cleaning resistance but also in ejection stability can be realized. A preferable acid value is 60 mgKOH/g or less.

The polyurethane (urethane resin) preferably has an average particle diameter of 20 to 300 nm, and since a polyurethane (urethane resin) having the average particle diameter as described above is used, an ink jet ink composition excellent not only in abrasion resistance and dry cleaning resistance but also in ejection stability can be realized. A more preferable average particle diameter of the polyurethane (urethane resin) is 30 to 200 nm. In addition, the average particle diameter is a volume average particle diameter which can be measured by a dynamic light scattering method using a Microtrac UPA150 (manufactured by Microtrac Inc.) or the like.

Although a solvent used for polymerization of each of the monomers mentioned above is not particularly limited, for example, a ketone-based solvent or an ether-based solvent may be mentioned. However, since the ink jet ink composition is an aqueous pigment dispersion, the solvent is preferably removed later. As the solvent described above, the following may be used. That is, as the ketone-based solvent, for example, acetone, methyl ethyl ketone, diethyl ketone, methyl isobutyl ketone, or cyclohexanone may be mentioned. In addition, as the ether-based solvent, for example, dibutyl ether, tetrahydrofuran, or dioxane may be mentioned.

The polyurethane (urethane resin) is preferably contained in an amount larger than that of a pigment dispersion on a mass basis. Since the polyurethane (urethane resin) in an amount larger than that of the pigment dispersion is added on a mass basis, in particular, as an ink jet recording ink for textile printing, the stability of pigment is improved.

As has thus been described, as the heat cross-linking component, for example, although a monomer or a precursor of the polyurethane (urethane resin) is preferable, as long as a cross-linking structure can be formed by heat stimulation, another compound may also be used as the heat cross-linking component. As the heat cross-linking component described above, for example, a heat polymerization initiator or a heat-curable monomer may be mentioned.

2.2. Other Components

The ink jet ink composition may contain, besides the above heat cross-linking component, (1) water, (2) a colorant, (3) an organic solvent, and (4) other components, each of which will be described below.

(1) Water

The ink jet ink composition may contain water. The ink jet ink composition is preferably an aqueous composition. The aqueous composition indicates a composition which contains water as one primary solvent component. Water may be contained as a primary solvent component and is a component to be evaporated by drying. The water is preferably purified water, such as ion-exchanged water, ultrafiltration water, reverse osmosis water, or distilled water or ultrapure water in which ionic impurities are removed as much as possible. In addition, when water sterilized by UV irradiation or addition of hydrogen peroxide is used, generation of bacteria and fungi can be preferably suppressed when the composition is stored for a long time. The content of the water with respect to the total mass of the ink jet ink composition is preferably 45 percent by mass or more, more preferably 50 to 98 percent by mass, and further preferably 55 to 95 percent by mass.

(2) Colorant

The ink jet ink composition may contain a colorant. As the colorant, for example, an inorganic pigment, such as a carbon black or a titanium white, an organic pigment, an oil-soluble dye, or a dispersive dye may be used. In the ink jet ink composition of this embodiment, the colorant may be dispersed by a dispersion resin.

As the inorganic pigment, for example, a carbon black (C.I. Pigment Black 7), such as a furnace black, a lamp black, an acetylene black, or a channel black, an iron oxide, a titanium oxide, a zinc oxide, or a silica may be used.

As the organic pigment, for example, there may be mentioned a quinacridone-based pigment, a quinacridone quinone-based pigment, a dioxazine-based pigment, a phthalocyanine-based pigment, an anthrapyrimidine-based pigment, an anthranthrone-based pigment, an indanthrone-based pigment, a flavanthrone-based pigment, a perylene-based pigment, a diketopyrrolopyrrole-based pigment, a perinone-based pigment, a quinophthalone-based pigment, an anthraquinone-based pigment, a thioindigo-based pigment, a benzimidazolone-based pigment, an isoindoline-based pigment, an azomethine-based pigment, or an azo-based pigment.

As a particular example of the organic pigment used for the ink jet ink composition, the following may be mentioned.

As the cyan pigment, for example, C.I. Pigment Blue 1, 2, 3, 15:3, 15:4, 15:34, 16, 22, or 60; or C.I. Vat Blue 4 or 60 may be mentioned. In addition, for example, one selected from the group consisting of C.I. Pigment Blue 15:3, 15:4, and 60 or a mixture containing at least two thereof may be preferably mentioned.

As the magenta pigment, for example, C.I. Pigment Red 5, 7, 12, 48(Ca), 48(Mn), 57(Ca), 57:1, 112, 122, 123, 168, 184, or 202; or C.I. Pigment Violet 19 may be mentioned. In addition, for example, one selected from the group consisting of C.I. Pigment Red 122, 202, and 209 and C.I. Pigment Violet 19 or a mixture or a solid solution containing at least two thereof may be preferably mentioned.

As the yellow pigment, for example, C.I. Pigment Yellow 1, 2, 3, 12, 13, 14C, 16, 17, 73, 74, 75, 83, 93, 95, 97, 98, 119, 110, 114, 128, 129, 138, 150, 151, 154, 155, 180, or 185 may be mentioned. In addition, for example, one selected from the group consisting of C.I. Pigment yellow 74, 109, 110, 128, and 138 or a mixture containing at least two thereof may be preferably mentioned.

pigments having colors different from those mentioned above may also be used. For example, an orange pigment and/or a green pigment may be mentioned.

The pigments mentioned above by way of example are examples of preferable pigments, and the present disclosure is not limited thereby. One of those pigments or a mixture containing at least two types thereof may be used, and those pigments each may be used in combination with a dye.

In addition, the pigment may be used after being dispersed using a dispersion agent selected from a water-soluble resin, a water-dispersible resin, a surfactant, or the like or may also be used after being dispersed as a self-dispersible pigment having a pigment surface oxidized or sulfonated by ozone, hypochlorous acid, fuming sulfuric acid, or the like.

In the ink jet ink composition of this embodiment, when the pigment is dispersed by a dispersion resin, a ratio of the pigment to the dispersion resin is preferably 10:1 to 1:10 and more preferably 4:1 to 1:3. In addition, when a volume average particle diameter of the pigment in a dispersed state is measured by a dynamic light scattering method, the maximum particle diameter is less than 500 nm, and the average particle diameter is 300 nm or less and more preferably 200 nm or less.

(3) Organic Solvent

The ink jet ink composition according to this embodiment may contain an organic solvent. Since the organic solvent is contained, for example, a drying property of a recorded matter and/or an image fastness may be improved in some cases. In addition, since the organic solvent is contained, the ejection stability of the ink jet ink composition can be improved. The organic solvent is preferably a water-soluble organic solvent.

In addition, as one function of the organic solvent, an improvement in wettability of the ink jet ink composition to the recording medium and/or an enhancement in moisture-retaining property of the ink jet ink composition may be mentioned. In addition, since the surface tension of the ink jet ink composition is decreased, when being ejected, the ink jet ink composition is separated in the form of liquid droplets from a nozzle and is easily projected therefrom, and since the wettability to the recording medium is improved, the spread of the ink droplets can be made excellent.

As the organic solvent, for example, an ester, an alkylene glycol ether, a cyclic ester, a nitrogen-containing solvent, or a polyvalent alcohol may be mentioned.

As the ester, for example, there may be mentioned a glycol monoacetate, such as ethylene glycol monomethyl ether acetate, ethylene glycol monoethyl ether acetate, ethylene glycol monobutyl ether acetate, diethylene glycol monomethyl ether acetate, diethylene glycol monoethyl ether acetate, diethylene glycol monobutyl ether acetate, propylene glycol monomethyl ether acetate, dipropylene glycol monomethyl ether acetate, or methoxybutyl acetate; or a glycol diester, such as ethylene glycol diacetate, diethylene glycol diacetate, propylene glycol diacetate, dipropylene glycol diacetate, ethylene glycol acetate propionate, ethylene glycol acetate butyrate, diethylene glycol acetate butyrate, diethylene glycol acetate propionate, diethylene glycol acetate butyrate, propylene glycol acetate propionate, propylene glycol acetate butyrate, dipropylene glycol acetate butyrate, or dipropylene glycol acetate propionate.

As the cyclic ester, for example, there may be mentioned a cyclic ester (lactone), such as β-propiolactone, γ-butyrolactone, δ-valerolactone, ε-caprolactone, β-butyrolactone, β-valerolactone, γ-valerolactone, β-hexanolactone, γ-hexanolactone, δ-hexanolactone, β-heptanolactone, γ-heptanolactone, δ-heptanolactone, ε-heptanolactone, γ-octanolactone, ε-octanolactone, ε-octanolactone, δ-nonalactone, ε-nonalactone, or ε-decanolactone or a compound in which a hydrogen of a methylene group adjacent to the carbonyl group thereof is substituted by an alkyl group having 1 to 4 carbon atoms.

As the nitrogen-containing solvent, for example, a non-cyclic amide or a cyclic amide may be mentioned. As the non-cyclic amide, for example, an alkoxyalkyl amide may be mentioned.

As the alkoxyalkyl amide, for example, there may be mentioned 3-methoxy-N,N-dimethyl propionamide, 3-methoxy-N,N-diethyl propionamide, 3-methoxy-N,N-methyl ethyl propionamide, 3-ethoxy-N,N-dimethyl propionamide, 3-ethoxy-N,N-diethyl propionamide, 3-ethoxy-N,N-methyl ethyl propionamide, 3-n-butoxy-N,N-dimethyl propionamide, 3-n-buthoxy-N,N-diethyl propionamide, 3-n-butoxy-N,N-methyl ethyl propionamide, 3-n-propoxy-N,N-dimethyl propionamide, 3-n-propoxy-N,N-diethyl propionamide, 3-n-propoxy-N,N-methyl ethyl propionamide, 3-iso-propoxy-N,N-dimethyl propionamide, 3-iso-propoxy-N,N-diethyl propionamide, 3-iso-propoxy-N,N-methyl ethyl propionamide, 3-tert-butoxy-N,N-dimethyl propionamide, 3-tert-butoxy-N,N-diethyl propionamide, or 3-tert-butoxy-N, N-methyl ethyl propionamide.

In addition, as the non-cyclic amide, an alkoxyalkyl amide which is a compound represented by the following general formula (1) may also be preferably used.

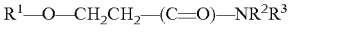

$$R^1—O—CH_2CH_2—(C=O)—NR^2R^3 \quad (1)$$

In the above formula (1), $R^1$ represents an alkyl group having 1 to 4 carbon atoms, and $R^2$ and $R^3$ each independently represent a methyl group or an ethyl group. The "alkyl group having 1 to 4 carbon atoms" may be a linear or a branched alkyl group, and for example, a methyl group, an ethyl group, an n-propyl group, an iso-propyl group, an n-butyl group, a sec-butyl group, an iso-butyl group, or a tert-butyl group may be mentioned. The compound represented by the above formula (1) may be used alone, or at least two types thereof may be used by mixing.

As the cyclic amide, a lactam may be mentioned, and for example, a pyrrolidone, such as 2-pyrrolidone, 1-methyl-2-pyrrolidone, 1-ethyl-2-pyrrolidone, 1-propyl-2-pyrrolidone, or 1-butyl-2-pyrrolidone, may be mentioned. Those compounds are each preferable since film formation of resin particles which will be described later is promoted, and in particular, 2-pyrrolidone is more preferable.

As the alkylene glycol ether, a monoether or a diether of an alkylene glycol may be used, and an alkyl ether is preferable. As a particular example, for example, there may be mentioned an alkylene glycol monoalkyl ether, such as ethylene glycol monomethyl ether, ethylene glycol monoethyl ether, ethylene glycol monoisopropyl ether, ethylene glycol monobutyl ether, diethylene glycol monomethyl ether, diethylene glycol monoethyl ether, ethylene glycol monobutyl ether, triethylene glycol monomethyl ether, triethylene glycol monoethyl ether, triethylene glycol monobutyl ether, tetraethylene glycol monomethyl ether, tetraethylene glycol monoethyl ether, tetraethylene glycol monobutyl ether, propylene glycol monomethyl ether, propylene glycol monoethyl ether, propylene glycol monopropyl ether, propylene glycol monobutyl ether, dipropylene glycol monomethyl ether, dipropylene glycol monoethyl ether, dipropylene glycol monopropyl ether, dipropylene glycol monobutyl ether, or tripropylene glycol monobutyl ether; or an alkylene glycol dialkyl ether, such as ethylene glycol dimethyl ether, ethylene glycol diethyl ether, ethylene glycol dibutyl ether, diethylene glycol dimethyl ether, diethylene glycol diethyl ether, diethylene glycol dibutyl ether, diethylene glycol methyl ethyl ether, diethylene glycol methyl butyl ether, triethylene glycol dimethyl ether, triethylene glycol diethyl ether, triethylene glycol dibutyl ether, triethylene glycol methyl butyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, dipropylene glycol diethyl ether, or tripropylene glycol dimethyl ether.

An alkylene glycol forming the alkylene glycol ether preferably has 2 to 8 carbon atoms, more preferably 2 to 6 carbon atoms, further preferably 2 to 4 carbon atoms, and particularly preferably 2 or 3 carbon atoms. The alkylene glycol forming the alkylene glycol ether may be a glycol formed by intermolecular condensation between hydroxy groups of alkylene glycol monomers. The number of condensations of the alkylene glycols is preferably 1 to 4, more preferably 1 to 3, and further preferably 2 or 3.

An ether forming the alkylene glycol ether is preferably an alkyl ether, and an alkyl ether having 1 to 4 carbon atoms is preferable, and an alkyl ether having 2 to 4 carbon atoms is more preferable.

Since the alkylene glycol ether is excellent in permeability and ink wettability to the recording medium, an excellent image quality is preferably obtained. In terms of the point described above, in particular, a monoether is preferable.

As the polyvalent alcohol, for example, there may be mentioned a 1,2-alkanediol (alkanediol, such as ethylene glycol, propylene glycol (propane-1,2-diol), 1,2-butanediol, 1,2-pentanediol, 1,2-hexanediol, 1,2-heptanediol, or 1,2-octanediol); or a polyvalent alcohol (polyol) other than an 1,2-alkanediol (such as ethylene glycol, propylene glycol, diethylene glycol, dipropylene glycol, triethylene glycol, 1,3-propanediol, 1,3-butanediol (1,3-butylene glycol), 1,4-butanediol, 1,5-pentanediol, 1,6-hexanediol, 2-ethyl-2-methyl-1,3-propanediol, 2-methyl-2-propyl-1,3-propanediol, 2-methyl-1,3-propanediol, 2,2-dimethyl-1,3-propanediol, 3-methyl-1,3-butanediol, 2-ethyl-1,3-hexanediol, 3-methyl-1,5-pentanediol, 2-methylpentane-2,4-diol, trimethylolpropane, or glycerin).

The polyvalent alcohol may be classified into an alkanediol and a polyol.

The alkanediol is a diol of an alkane having at least 5 carbon atoms. The number of carbon atoms of the alkane is preferably 5 to 15, more preferably 6 to 10, and further preferably 6 to 8. A 1,2-alakendiol is preferable.

The polyol is a polyol of an alkane having 4 carbon atoms or less or an intermolecular condensate between hydroxy groups of polyols of alkanes each having 4 carbon atoms or less. The number of carbon atoms of the alkane is preferably 2 to 3. The number of hydroxy groups in the molecule of the polyol is 2 or more, preferably 5 or less, and more preferably 3 or less. When the polyol is the intermolecular condensate described above, the number of intermolecular condensations is 2 or more, preferably 4 or less, and more preferably 3 or less. The polyvalent alcohol may be used alone, or at least two types thereof may be used by mixing.

The alkanediol and the polyol may primarily function as a penetrating solvent and/or a moisturizing solvent. However, the alkanediol tends to have a relatively strong function as the penetrating solvent, and the polyol tends to have a relatively strong function as the moisturizing solvent.

Since the alkanediol has a strong function as the penetrating solvent, the ink wettability to the recording medium is improved, and hence, an excellent ink spread and an excellent image quality are preferably obtained.

For the ink jet ink composition, the organic solvents mentioned above by way of example may be used alone, or at least two types thereof may be used in combination. When at least two types of organic solvents are used, the content thereof is the total content of the organic solvents.

In the ink jet ink composition, the total content of the organic solvent with respect to the total mass of the ink jet ink composition is preferably 40.0 percent by mass or less and more preferably 35.0 percent by mass or less. On the other hand, a lower limit of the content is preferably 10.0 percent by mass or more, more preferably 20.0 percent by mass or more, and further preferably 25.0 percent by mass or more.

Furthermore, a normal boiling point of the organic solvent contained in the ink jet ink composition is preferably 280.0° C. or less, more preferably 150.0° C. to 280.0° C., even more preferably 170.0° C. to 280.0° C., further preferably 180.0° C. to 280.0° C., more further preferably 190.0° C. to 270.0° C., and even more further preferably 200.0° C. to 250.0° C.

In addition, in the ink jet ink composition, the content of an organic solvent having a normal boiling point of 280.0° C. or more is 10.0 to 30.0 percent by mass and preferably 10.0 to 20.0 percent by mass. Accordingly, in particular, since the content of the organic solvent is the lower limit or more, even when the belt is heated, drying of the ink jet ink composition can be suppressed. Hence, even when being adhered to the belt, the ink jet ink composition is prevented from being fixed to the belt, and hence, the belt can be easily washed. In addition, since the content of the organic solvent is the lower limit or more, the ink jet ink composition is suppressed from being dried in a nozzle, and hence, the ejection stability can be improved. In addition, in particular, since the content of the organic solvent is the upper limit or less, when the ink jet ink composition adhered to the recording medium is dried by heating, a drying property of the ink jet ink composition is improved, and an adhesion thereof to the recording medium can be improved. As an organic solvent having a normal boiling point of more than 280.0° C., for example, glycerin or a polyethylene glycol monomethyl ether may be mentioned.

(4) Other Components

The ink jet ink composition may further contain the following components.

Surfactant

The ink jet ink composition may also contain a surfactant. The surfactant has a function to decrease the surface tension of the ink jet ink composition and to improve the wettability to the recording medium and/or a base material. Among the surfactants, an acetylene glycol-based surfactant, a silicone-based surfactant, or a fluorine-based surfactant may be preferably used.

Although the acetylene glycol-based surfactant is not particularly limited, for example, there may be mentioned Surfynol 104, 104E, 104H, 104A, 104BC, 104DPM, 104PA, 104PG-50, 104S, 420, 440, 465, 485, SE, SE-F, 504, 61, DF37, CT111, CT121, CT131, CT136, TG, GA, or DF110D (trade name, manufactured by Air Product and Chemicals Inc.); Olfine B, Y, P, A, STG, SPC, E1004, E1010, PD-001, PD-002W, PD-003, PD-004, EXP.4001, EXP.4036, EXP.4051, AF-103, AF-104, AK-02, SK-14, or AE-3 (trade name, manufactured by Nisshin Chemical Industry Co., Ltd.); or Acetylenol E00, E00P, E40, or E100 (trade name, manufactured by Kawaken Fine Chemicals Co., Ltd.).

Although the silicone-based surfactant is not particularly limited, a polysiloxane-based compound may be preferably mentioned. Although the polysiloxane-based compound is not particularly limited, for example, a polyether-modified organosiloxane may be mentioned. As a commercially available product of the polyether-modified organosiloxane, for example, there may be mentioned BYK-306, BYK-307, BYK-333, BYK-341, BYK-345, BYK-346, or BYK-348 (trade name, manufactured by BYK Japan KK); KF-351A, KF-352A, KF-353, KF-354L, KF-355A, KF-615A, KF-945, KF-640, KF-642, KF-643, KF-6020, X-22-4515, KF-6011, KF-6012, KF-6015, or KF-6017 (trade name, manufactured by Shin-Etsu Chemical Co., Ltd.).

As the fluorine-based surfactant, a fluorine-modified polymer is preferably used, and as a particular example, BYK-3440 (trade name, manufactured by BYK Japan KK), Surflon S-241, S-242, or S-243 (trade name, manufactured by AGC Seimi Chemical Co., Ltd.), or Ftergent 215M (trade name, manufactured by Neos Co., Ltd.) may be mentioned.

When the surfactant is contained in the ink jet ink composition, a plurality of surfactants may be contained. When the surfactant is contained in the ink jet ink composition, the content with respect to the total mass is preferably 0.1 to 2.0 percent by mass, more preferably 0.2. 1.5 percent by mass, and even more preferably 0.3 to 1.0 percent by mass.

pH Adjuster

The ink jet ink composition of this embodiment may also contain a pH adjuster. Since being contained, for example, the pH adjuster can suppress or promote dissolution of impurities from a member forming an ink flow path and can adjust a washing property of the ink jet ink composition. As the pH adjuster, for example, an urea, an amine, a morpholine, a piperazine, or an aminoalcohol, such as triethanolamine, may be mentioned. In particular, for example, there may be mentioned urea, ethyleneurea, tetramethylurea, thiourea, 1,3-dimethyl-2-imidazolidinone, or the like or a betaine (trimethylglycine, triethylglycine, tripropylglycine, triisopropylglycine, N,N,N-trimethylalanine, N,N,N-triethylalanine, N,N,N-triisopropylalanine, N,N,N-trimethylmethylalanine, carnitine, acetylcarnitine, or the like). As the amine, for example, diethanolamine, triethanolamine, or triisopropanolamine may be mentioned.

The compound mentioned by way of example as the pH adjuster is not regarded as the organic solvent mentioned above. For example, although triethanolamine is a liquid at ordinary temperature and has a normal boiling point of approximately 208° C., this compound is not regarded as the organic solvent mentioned above.

Antiseptic Agent

The ink jet ink composition of this embodiment may also contain an antiseptic agent.

Since the antiseptic agent is contained, proliferation of fungi and/or bacteria can be suppressed, and storage stability of the ink composition is further improved. Accordingly, for example, the ink jet ink composition can be preferably used as a maintenance liquid when a printer is maintained for a long time without being used. As a preferable example of the antiseptic agent, for example, Proxel CRL, Proxel BDN, Proxel GXL, Proxel XL-2, Proxel IB, or Proxel TN may be mentioned.

Others

The ink jet ink composition may also contain, if needed, various additives, such as a chelating agent, a rust inhibitor, a fungicide, an antioxidant, a reduction inhibitor, an evaporation accelerator, and/or a water-soluble resin.

As the chelating agent, for example, ethylenediaminetetraacetic acid (EDTA), a nitrilotriacetate salt of ethylenediamine, a hexametaphosphate salt, a pyrophosphate salt, or a metaphosphate salt may be mentioned.

2.3. Physical Properties of Ink Jet Ink Composition

The ink jet ink composition is adhered to the recording medium by an ink jet method (ink adhesion step). Hence, the viscosity of the ink jet ink composition at 20° C. is set to preferably 1.5 to 15.0 mPa·s, more preferably 1.5 to 7.0 mPa·s, and further preferably 1.5 to 5.5 mPa·s. Since the ink jet ink composition is ejected from an ink jet head and is then adhered to the recording medium, a predetermined image can be efficiently and easily formed on the recording medium.

In order to obtain an appropriate wet spreading property to the recording medium, the ink jet ink composition to be used in an ink jet recording method of this embodiment has a surface tension at 25.0° C. of 40.0 mN/m or less, preferably 38.0 mN/m or less, more preferably 35.0 mN/m or less, and further preferably 30.0 mN/m or less.

2.4. Method for Manufacturing Ink Jet Ink Composition

Although a method for manufacturing the ink jet ink composition of this embodiment is not particularly limited, for example, when the components described above are mixed together in an arbitrary order, and if needed, impurities are removed by filtration or the like, the ink jet ink composition can be manufactured. As a method for mixing the components, a method in which the components are sequentially added in a container equipped with a mechanical stirrer, a magnetic stirrer, or the like and are then mixed together by stirring is preferably used.

3. Reaction Temperature of Heat Cross-Linking Component

The reaction temperature of the heat cross-linking component of the ink jet ink composition described above is defined as follows. The reaction temperature is determined by a differential scanning calorimetry (DSC). Since the reaction of the heat cross-linking component is associated with an endothermic and an exothermic process, clear exothermic and/or endothermic peaks is not likely to be observed on a DSC chart, and as a result, a complicated curve may be formed in many cases. Hence, absolute values of amounts shifted from a base line of the DSC chart are integrated, and a temperature at which an integrated value of 4 mJ/mg is obtained is defined as the reaction temperature of the heat cross-linking component.

In more particular, after the heat cross-linking component is sealed in a sample pan, the temperature thereof is increased, for example, from a low temperature of −40° C. to a high temperature of 160° C. at a temperature increase rate of 5° C./min. As described above, a base line in a temperature increase process before the reaction is obtained. Subsequently, the base line obtained before the reaction is extended from a low temperature side, and an absolute value of the difference in heat amount between the DSC chart and the base line (standard line) is integrated from the low temperature side to a high temperature side. A temperature at which the integrated value of the heat amount reaches 4 mJ/mg is obtained and is regarded as the reaction temperature of the heat cross-linking component. In addition, in the case in which the base line of the chart is difficult to determine, for example, a heat amount at 25° C. of the chart is regarded as the standard, and the difference therefrom is integrated to the high temperature side so as to determine the reaction temperature of the heat cross-linking component.

Although the heat cross-linking component is assumed to slightly react at the reaction temperature, a cross-linking density thereof is believed to be low. Hence, at a temperature lower than this temperature, the molecules of the heat cross-linking component are believed in a flexible state. The heat cross-linking component in this state is likely, for example, to be dissolved and/or swelled, and hence, the heat cross-linking component is able to strongly receive a washing operation by water and/or an alcohol supplied by the above washing portion 51.

In the ink jet printing recording apparatus of this embodiment, the surface 23*a* of the belt 23 is heated by the heating portion to a temperature lower than the reaction temperature of the heat cross-linking component. Accordingly, when the ink jet ink composition is intentionally or not intentionally adhered to the belt 23, the ink jet ink composition can be easily removed from the belt 23 by the washing portion 51.

In addition, when the reaction of the heat cross-linking component is sufficiently advanced, the ink jet ink composition adhered to the recording medium 95 can be tightly adhered thereto, and hence, an image having a high abrasion fastness can be formed.

For example, when an urethane resin having a cross-linking group, such as an isocyanate group, is used as the heat cross-linking component, the heating temperature is preferably 80° C. or less, more preferably 70° C. or less, and further preferably 60° C. or less. When the heating temperature is as described above, the heating temperature is likely to be lower than the reaction temperature of the heat cross-linking component, and when the ink jet ink composition is adhered to the belt 23, the ink jet ink composition tends to be easily removed from the belt 23 by the washing portion 51. That is, the temperature of the surface 23*a* of the belt 23 is preferably 80° C. or less, more preferably 70° C. or less, and further preferably 60° C. or less.

4. Ink Jet Recording Method

The ink jet recording method of this embodiment can be easily realized by the ink jet printing recording apparatus 100 described above. That is, the ink jet recording method of this embodiment includes a step of heating the belt 23 which is provided with an adhesive layer and which supports the recording medium 95 and a step of ejecting the ink jet ink composition described above from the ink jet recording head to as to be adhered to the recording medium 95 supported by the belt 23, the ink jet ink composition contains a heat cross-linking component, and in the step of heating the belt 23, the belt 23 is heated to a temperature lower than a reaction temperature of the heat cross-linking component.

According to the ink jet recording method of this embodiment, since the ink jet ink composition contains the heat cross-linking component, the abrasion fastness of an image to be formed can be improved. In addition, since the reaction of the heat cross-linking component of the ink jet ink composition is suppressed by the heating performed in the heating step, even when being adhered to the belt, the ink jet ink composition is suppressed from being fixed to the belt, and the belt can be easily washed.

In addition, the ink jet recording method of this embodiment may further include a washing step of washing the belt 23. The washing step can be performed by the washing portion 51 of the ink jet printing recording apparatus 100 described above.

Furthermore, the ink jet recording method of this embodiment may further include a step of heating the recording medium to a temperature higher than the reaction temperature of the heat cross-linking component. The heating described above can be performed using the heating unit 27 of the ink jet printing recording apparatus 100 described above.

5. Experiments

Hereinafter, although examples of the present disclosure will be described in detail, the present disclosure is not limited to those examples. In addition, "part(s)" and "%" are each based on a mass basis unless otherwise particularly noted. In addition, unless otherwise specifically noted, evaluation was performed in an environment at a temperature of 25.0° C. and a relative humidity of 40.0%.

5.1. Preparation of Ink Composition

After components were received in a container so as to have a composition shown in Table 1 and were then mixed and stirred for 2 hours by a magnetic stirrer, a mixture thus obtained was sufficiently mixed by a dispersion treatment using a bead mill in which zirconia beads each having a diameter of 0.3 mm were charged. After the stirring was performed for 1 hour, filtration was performed using a 5.0-μm PTFE-made membrane filter, so that ink compositions according to examples and comparative examples were obtained. The numerical value in Table 1 indicates percent by mass. As water, ion-exchanged water was used and was added so that the mass of each ink composition was 100 percent by mass. In addition, in the table, the contents of UW-1527F and W6010 are each a solid component amount.

TABLE 1

| | EXAMPLE 1 | EXAMPLE 2 | EXAMPLE 3 | EXAMPLE 4 | EXAMPLE 5 | EXAMPLE 6 | COMPARATIVE EXAMPLE 1 | COMPARATIVE EXAMPLE 2 |
|---|---|---|---|---|---|---|---|---|
| BELT HEATING TEMPERATURE (MAXIMUM TEMPERATURE) | 50° C. | 50° C. | 50° C. | 50° C. | 50° C. | 60° C. | 90° C. | 50° C. |
| UW-1527F | 4.0 | 6.0 | 4.0 | 4.0 | 1.0 | 4.0 | 4.0 | — |
| W6010 | — | — | — | — | — | — | — | 4.0 |
| PB15:3 | 3.5 | 3.5 | 3.5 | 3.5 | 3.5 | 3.5 | 3.5 | 3.5 |
| Glycerin | 12.8 | 12.8 | 25.0 | 7.0 | 12.8 | 12.8 | 12.8 | 12.8 |
| TEG | 4.5 | 4.5 | 4.5 | 4.5 | 4.5 | 4.5 | 4.5 | 4.5 |
| BTG | 0.7 | 0.7 | 0.7 | 0.7 | 0.7 | 0.7 | 0.7 | 0.7 |
| E1010 | 0.5 | 0.5 | 0.5 | 0.5 | 0.5 | 0.5 | 0.5 | 0.5 |
| TEA | 1.0 | 1.0 | 1.0 | 1.0 | 1.0 | 1.0 | 1.0 | 1.0 |
| WATER | BALANCE | BALANCE | BALANCE | BALANCE | BALANCE | BALANCE | BALANCE | BALANCE |
| ENDOTHERMIC/ EXOTHERMIC HEAT AMOUNT FROM 25° C. TO HEATING TEMPERATURE (mJ/mg) | | | 4.0 OR LESS | | | | MORE THAN 4.0 | 4.0 OR LESS |

TABLE 1-continued

| | EXAMPLE 1 | EXAMPLE 2 | EXAMPLE 3 | EXAMPLE 4 | EXAMPLE 5 | EXAMPLE 6 | COMPARATIVE EXAMPLE 1 | COMPARATIVE EXAMPLE 2 |
|---|---|---|---|---|---|---|---|---|
| WASHING PROPERTY | A | A | A | B | A | A | C | A |
| ABRASION FASTNESS | A | A | B | A | C | A | A | D |

Among the components shown in Table 1, UW-1527F indicates model No. UW-1527F of ETANACOLL (registered trademark) UW Series manufactured by Ube Industries, Inc. In addition, W6010 indicates model No. W6010 of Takelac (registered trademark) manufactured by Mitsui Chemicals Inc. TEG indicates triethylene glycol (reagent), BTG indicates butyl triglycol (triethylene glycol monobutyl ether), E1010 indicates Olfine (registered trademark) E1010 (acetylene glycol-based surfactant) manufactured by Nisshin Chemical Industry Co., Ltd., and TEA indicates triethanolamine (reagent). In addition, PB 15:3 indicates C.I. Pigment Blue 15:3. In addition, UW-1527F is an urethane resin having a heat cross-linkable reactivity, and W6010 is an urethane resin having no heat cross-linkable reactivity.

5.2. DSC Measurement

After being received in a wide-mouth container, 10 g of UW-1527 in an emulsion state was dried for 24 hours or more until being solidified at room temperature (23° C.). After 10 to 15 mg of a dried solid compound was taken out of the container, a measurement was performed using a differential scanning calorimeter (EXSTAR6000 DSC6220, manufactured by SII Nano Technology Inc.) from −40° C. to 160° C. at a temperature increase rate of 5° C./min. From an obtained DSC chart, the heat amounts from 25° C. to 50° C., 60° C., and 90° C. were calculated by integration using attached analysis software. In each example, it was judged whether the integrated heat amount to the temperature at which the belt was heated exceeded or not an integrated heat amount of 4.0 mJ/mg which indicated the reaction temperature, and the result is shown in Table 1.

5.3. Evaluation of Washing Property

An apparatus similar to the ink jet printing recording apparatus 100 described in the above embodiment was used. As the recording medium 95, a white cotton broadcloth containing 100% of cotton was used. In addition, As the adhesive 29, "ATRASOL GP1 (ATR code: ATR1717)" manufactured by ATR CHEMICALS was used. Before the recording medium 95 reached the carriage transfer portion 45 (head unit), the ink jet ink composition of each example was ejected and adhered to the belt 23. Subsequently, when a portion of the belt 23 to which the ink jet ink composition was adhered passed through the washing portion 51 and then reached the medium contact portion 60 so as to be adhered to a new recording medium 95, the degree of adhesion of the ink jet ink composition to a surface of the recording medium 95 opposite to a recording surface thereof was evaluated in accordance with the following criteria, and the results are described in Table 1. When the evaluation result is B or better, a preferable washing property is assumed to be obtained.

A: No adhesion of the ink jet ink composition on the belt is observed.

B: Although no adhesion of the ink jet ink composition on the belt is confirmed by visual inspection, when the belt is rubbed with a finger, the ink jet ink composition is adhered to the finger.

C: Adhesion of the ink jet ink composition on the belt is observed (by visual inspection).

5.4. Evaluation of Abrasion Fastness

By using a Gakusin-type abrasion fastness tester (trade name: "AB-301", manufactured by Tester Sangyo Co., Ltd.), an abrasion fastness of an obtained printed matter was evaluated. In addition, heat drying after printing was performed at 165° C. The evaluation of the abrasion fastness was performed such that a friction block covered with a white cotton cloth was reciprocally rubbed 100 times on the surface of the recording medium 95 with a load of 200 g. Subsequently, stains on the white cotton cloth and the degree of peeling of the ink jet ink composition from the printed matter were observed by visual inspection. When the evaluation result is C or better, a preferable abrasion fastness is assumed to be obtained.

A: No stains are observed on the white cotton cloth, and no peeling of the printed matter is observed.

B: Although stains are observed on the white cotton cloth, no peeling of the printed matter is observed.

C: Stains are observed on the white cotton cloth, and slight peeling is observed in an area of 20% or less of the printed matter.

D: Stains are observed over the entire surface of the white cotton cloth, and peeling is observed in an area of more than 20% of the printed matter.

5.5. Evaluation Results

According to the examples in each of which the belt which supports the recording medium, the heating portion which heats the belt, and the ink jet recording head which ejects the ink jet ink composition are provided; the belt is provided with the adhesive layer; the ink jet ink composition contains the heat cross-linking component; and the belt is heated by the heating portion to a temperature lower than the reaction temperature of the heat cross-linking component, it is found that the belt washing property and the abrasion fastness can both be improved. In Comparative Example 2 in which the resin having no heat cross-linkable reactivity is used, it is found that although the belt washing property is preferable, the abrasion fastness is insufficient. In addition, in Comparative Example 1 in which the belt was heated by the heating portion to a temperature higher than the reaction temperature of the heat cross-linking component, it is found that the belt washing property cannot be obtained.

The embodiments and the modified examples described above are described by way of example, and the present disclosure is not limited thereto. For example, the embodiments and the modified examples may be appropriately used in combination.

The present disclosure includes substantially the same structure, such as the same structure in terms of the function, the method, and the result or the same structure in terms of the object and the effect, as the structure described in the embodiment. In addition, the present disclosure includes the structure in which a nonessential portion of the structure described in the embodiment is replaced with something else. In addition, the present disclosure includes the structure which performs the same operational effect as that of the structure described in the embodiment or the structure which is able to achieve the same object as that of the structure described in the embodiment. In addition, the present disclosure includes the structure in which a known technique is added to the structure described in the embodiment.

From the embodiments and the modified examples, the following contents can be obtained.

According to an aspect of the present disclosure, there is provided an ink jet printing recording apparatus which comprises: a belt which supports a recording medium; a heating portion which heats the belt; and an ink jet recording head which ejects an ink jet ink composition, the belt is provided with an adhesive layer, the ink jet ink composition contains a heat cross-linking component, and the belt is heated by the heating portion to a temperature lower than a reaction temperature of the heat cross-linking component.

According to the ink jet printing recording apparatus described above, since the ink jet ink composition contains the heat cross-linking component, an abrasion fastness of an image to be formed can be enhanced. In addition, since the reaction of the heat cross-linking component of the ink jet ink composition can be suppressed by heating performed by the heating portion, even when being adhered to the belt, the ink jet ink composition is suppressed from being fixed thereto, and hence, the belt can be easily washed.

The ink jet printing recording apparatus according to the aspect may further comprise a washing portion which washes the belt.

According to the ink jet printing recording apparatus described above, the belt can be efficiently washed.

In the ink jet printing recording apparatus according to the aspect, the belt may be an endless belt.

According to the ink jet printing recording apparatus described above, the recording medium can be more stably transported.

In the ink jet printing recording apparatus according to the aspect, the heat cross-linking component may be an urethane resin having a cross-linking group.

According to the ink jet printing recording apparatus described above, an image having a more preferable abrasion fastness can be recorded.

In the ink jet printing recording apparatus according to the aspect, the urethane resin may be a polycarbonate-based urethane resin and may have a rupture elongation of 200% to 600%.

According to the ink jet printing recording apparatus described above, an image having a more preferable abrasion fastness can be recorded.

In the ink jet printing recording apparatus according to the aspect, the ink jet ink composition may contain an organic solvent having a normal boiling point of 280° C. or more in an amount of 10.0 to 30.0 percent by mass with respect to the total mass of the ink jet ink composition.

According to the ink jet printing recording apparatus described above, since the organic solvent which has a high normal boiling point and which is not likely to be evaporated is contained in a predetermined amount or more, drying of the ink jet ink composition caused by heating performed by the heating portion is suppressed, and even when being adhered to the belt, the ink jet ink composition is suppressed from being fixed thereto, so that the belt can be easily washed.

According to another aspect of the present disclosure, there is provided an ink jet recording method which comprises: a step of heating a belt which is provided with an adhesive layer and which supports a recording medium; and a step of ejecting an ink jet ink composition from an ink jet recording head so as to be adhered to the recording medium supported by the belt, the ink jet ink composition contains a heat cross-linking component, and in the step of heating a belt, the belt is heated to a temperature lower than a reaction temperature of the heat cross-linking component.

According to the ink jet recording method described above, since the ink jet ink composition contains the heat cross-linking component, an abrasion fastness of an image to be formed can be improved. In addition, since the reaction of the heat cross-linking component of the ink jet ink composition can be suppressed by heating performed in the heating step, even when being adhered to the belt, the ink jet ink composition is suppressed from being fixed thereto, and hence, the belt can be easily washed.

The ink jet recording method according to the aspect may further comprise a washing step of washing the belt.

According to the ink jet recording method described above, an image having a preferable abrasion fastness can be more efficiently formed.

The ink jet recording method according to the aspect may further comprise a step of heating the recording medium to a temperature higher than the reaction temperature of the heat cross-linking component.

According to the ink jet recording method described above, an image having a preferable abrasion fastness can be more efficiently formed.

What is claimed is:

1. An ink jet printing recording apparatus comprising:

a belt which supports a recording medium;

a heating portion which heats the belt; and an ink jet recording head which ejects an ink jet ink composition, wherein the belt is provided with an adhesive layer, the ink jet ink composition contains a heat cross-linking component, and the belt is heated by the heating portion to a temperature lower than a reaction temperature of the heat cross-linking component.

2. The ink jet printing recording apparatus according to claim 1, further comprising:

a washing portion which washes the belt.

3. The ink jet printing recording apparatus according to claim 1, wherein the belt is an endless belt.

4. The ink jet printing recording apparatus according to claim 1, wherein the heat cross-linking component is an urethane resin having a cross-linking group.

5. The ink jet printing recording apparatus according to claim 4, wherein the urethane resin is a polycarbonate-based urethane resin and has a rupture elongation of 200% to 600%.

6. The ink jet printing recording apparatus according to claim 1, wherein the ink jet ink composition contains an organic solvent having a normal boiling point of 280° C. or more in an amount of 10.0 to 30.0 percent by mass with respect to the total mass of the ink jet ink composition.

7. An ink jet recording method comprising:

heating a belt which is provided with an adhesive layer and which supports a recording medium; and ejecting an ink jet ink composition from an ink jet recording head so as to be adhered to the recording medium supported by the belt, wherein the ink jet ink composition contains a heat cross-linking component, and in the heating a belt, the belt is heated to a temperature lower than a reaction temperature of the heat cross-linking component.

8. The ink jet recording method according to claim 7, further comprising:

a washing step of washing the belt.

9. The ink jet recording method according to claim 7, further comprising:

heating the recording medium to a temperature higher than the reaction temperature of the heat cross-linking component.

* * * * *